US005913539A

United States Patent [19]

Exline et al.

[11] Patent Number: 5,913,539

[45] Date of Patent: Jun. 22, 1999

[54] WALLET SIZE CARD BOOK

[75] Inventors: William B. Exline, Chagrin Falls; Michael P. Exline, Novelty, both of Ohio

[73] Assignee: William Exline, Inc., Cleveland, Ohio

[21] Appl. No.: 08/909,665

[22] Filed: Aug. 12, 1997

[51] Int. Cl.[6] ..... B42D 1/00

[52] U.S. Cl. ..... 281/2; 281/3; 281/5; 281/31; 281/15.1

[58] Field of Search ..... 281/2, 3.1, 5, 2.9, 281/31, 38, 15.1, 37; 283/34, 36, 56; D3/247

[56] References Cited

U.S. PATENT DOCUMENTS

| | | | |
|---|---|---|---|
| 286,650 | 10/1883 | Talcott . | |
| 807,648 | 12/1905 | Wiggins . | |
| 1,912,710 | 5/1933 | Kennedy . | |
| 2,634,777 | 4/1953 | Berger | 150/59 |
| 2,718,911 | 9/1955 | Solomon | 150/39 |
| 2,767,756 | 10/1956 | Niles | 150/39 |
| 3,172,687 | 3/1965 | Lawrence | 281/31 |
| 3,201,146 | 8/1965 | Tilton, Jr. | 281/31 |
| 3,310,321 | 3/1967 | Freund | 281/31 |
| 3,360,027 | 12/1967 | Price | 150/39 |
| 3,433,279 | 3/1969 | Seamon | 150/39 |
| 3,537,728 | 11/1970 | Reese | 281/31 |
| 4,216,979 | 8/1980 | Janik | 283/58 |
| 4,492,390 | 1/1985 | Jacobs et al. | 281/31 |
| 4,586,729 | 5/1986 | Beylerian | 281/5 |
| 4,620,725 | 11/1986 | Maehashi | 281/45 |
| 4,621,729 | 11/1986 | Jackson | 206/37 |
| 4,758,469 | 7/1988 | Lange | 428/325 |
| 4,896,027 | 1/1990 | Drexler | 235/488 |
| 5,143,405 | 9/1992 | Daneshvar | 281/31 |
| 5,156,898 | 10/1992 | McDonald | 428/100 |
| 5,342,093 | 8/1994 | Weernink | 283/81 |
| 5,362,103 | 11/1994 | Bromberg | 281/29 |
| 5,468,231 | 11/1995 | Newman et al. | 604/180 |
| 5,595,401 | 1/1997 | Exline et al. | 281/2 |
| 5,800,659 | 9/1998 | Exline et al. | 156/250 |

OTHER PUBLICATIONS

Photocopy of William Exline Inc. brochure; Jan. 1995; and sample.

Photocopy of Didde–Glaser, Inc. brochure, date unknown but believed to be prior art.

*Primary Examiner*—Frances Han

*Attorney, Agent, or Firm*—Rhodes, Coats & Bennett, L.L.P.

[57] ABSTRACT

An improved wallet size card book which has been adapted to hold a card having the dimensions of a conventional credit card, and is particularly designed to be carried in the credit card compartment of a wallet or similar size compartment holder. The card book comprises: a) a cover having a fold which divides the cover into a front cover panel and a rear cover panel; b) a plurality of leaves attached along one marginal edge at the fold to form pages, each of the leaves and the front and rear cover panels being coextensive; c) a flood coated adhesive sealing the front surface of the first leaf to the inner surface of the front cover panel; d) an adhesive strip extending along at least two adjacent edges of the rear surface of the first leaf; and e) a pocket formed by the front surface of the first leaf being sealed to the inner surface of the front cover panel and a second leaf being sealed to the first leaf along the two adjacent edges by the adhesive strip. The use of the adhesive strip along the adjacent edges of the first leaf in the card book makes it possible to create a properly formed pocket for holding and protecting the card. The preferred adhesives for the strip include latexes of polyvinyl ethylene, polyvinyl acetate, other acrylics, and copolymers thereof. The preferred adhesive is a polyvinyl acetate copolymer latex having a glass transition temperature (Tg) approximately room temperature or below.

8 Claims, 3 Drawing Sheets

WALLET SIZE CARD BOOK

BACKGROUND OF THE INVENTION

1. Field of the Invention

The present invention relates generally to an improved wallet size card book, which is constructed to hold a card having dimensions of a conventional credit card and fit within the credit card compartment of a wallet or similar type cardholder. More particularly, the present invention relates to a wallet size card book in which an L-shaped adhesive strip is applied on a substrate in a prescribed pattern.

2. Description of the Prior Art

Various booklets or folders having card holder pockets and a place to record information or transactions are currently in use. For example, U.S. Pat. No. 5,143,405 (Daneshvar) discloses a booklet for collecting and presenting personal medical information. Although the booklets include pockets formed in the covers of the booklets, the disclosure provides that the pockets may be used to hold additional papers containing medical information. The suggested size of the booklet is approximately 4"×6½", and by size alone, would not conveniently fit into the user's wallet. Further, there is no indicated use of the pockets for holding identification and credit cards.

U.S. Pat. No. 4,621,729 (Jackson) discloses a patient medical information and education container which may be wallet size. Although a pocket is provided which serves to hold a plurality of cards or the like, the user must open a plurality of panels of the container to retrieve a card from the pocket.

U.S. Pat. No. 2,767,756 (Niles) discloses a foldable unit plastic card holder designed to hold a number of cards. However, the card holder does not include any pages on which to record transactions or maintain record-keeping.

U.S. Pat. No. 3,360,027 (Price) discloses a ticket and money holder provided with openings with arcuate lower edges through which tickets and the like may be inserted into and removed from the holder. The holder includes an outer sheet which is stitched to a filler.

Standard size card books are also available, for example, savings and passbooks. However, these card books are too cumbersome in size to fit within the compartments of a wallet. Moreover, attempts to produce wallet size card books have been unsuccessful because the available marginal width is not sufficient to obtain a strong glue bond with previously used adhesives.

To overcome the disadvantages presented by the prior art, the inventors of the present invention initially developed a wallet size card book, which is constructed to fit within a wallet, yet is strong enough to survive normal usage (see U.S. Pat. No. 5,595,401 to Exline et al. and co-pending continuation-in-part U.S. application Ser. No. 08/783,813, filed Jan. 16, 1997, the disclosures of each being hereby incorporated by reference in their entireties). U.S. Pat. No. 5,595,401 discloses a smaller size card book having dimensions of approximately 2½ inches by 3½ inches. The wallet size card book includes: (a) a cover having a fold which divides the cover into a front cover panel and a rear cover panel; (b) a plurality of leaves attached at the fold, the leaves forming pages; (c) a L-shaped adhesive strip extended along two edges of the inner surface of the cover; and (d) a pocket formed by a first leaf sealed to the inner surface of the cover and cut shorter and narrower than the cover, a second leaf sealed along two adjacent edges to the L-shaped adhesive strip on the cover with a third edge secured to the fold by stitching, gluing or stapling, and a fourth edge remaining open for receiving a credit or information card. The smaller size coupled with the same standard size for credit cards requires a substantially narrower adhesive or glue strip along the two adjacent sides in the card book having the following properties: 1) sufficient bond strength; 2) fast cure to porous substrates under ambient conditions; and 3) sufficient bond flexibility.

U.S. application Ser. No. 08/783,813 to Exline et al. discloses an adhesive strip that is used to seal the leaves of the wallet size card books described in U.S. Pat. No. 5,595,401. The adhesive strip comprises an adhesive selected from the group consisting of latexes of polyvinyl ethylene, polyvinyl acetate, acrylics and any copolymer thereof, natural rubber latex, natural rubber solvent-based, protein glue, carbohydrate polymer, aerobic adhesives, cyanoacrylates, silicones, and epoxy resins. The preferred adhesive is a polyvinyl acetate copolymer latex with a glass transition temperature (Tg) approximately near or below room temperature. The use of a resin emulsion adhesive, preferably a polyvinyl acetate copolymer emulsion, makes it possible to create a properly formed pocket for holding and protecting the card.

In producing the wallet size card book disclosed in U.S. Pat. No. 5,595,401, at least one card book is placed in an open position where the plurality of leaves are attached to the fold of the cover. The first or fly leaf is cut shorter and narrower than the cover so that when the resin emulsion adhesive is applied to the entire inner surface of the cover, the first leaf completely adheres to the cover and leaves an L-shaped adhesive strip exposed along the marginal edges of the inner surface of the cover. As a result, a second leaf adheres to the L-shaped adhesive strip that remains exposed on the inner surface of the cover, thereby forming a pocket with a third edge being attached at the fold and a fourth edge remaining open for receiving a wallet size card book. During the process of constructing the card book, anywhere from approximately 12–18 books may be placed between two dies immediately after the resin emulsion is applied. The die includes a lower strip and an upper narrow strip. A plurality of openings exists between the upper and lower strips. Between adjacent openings are adjoining strips.

The books and dies are placed in an air-powered vise, and thereafter squeezed together in order to set the adhesive. The vise is squeezed under approximately 2800 lbs/in$^2$ of pressure for a sufficient amount of time in which to properly seal the adhesive to the cover of the card book. In a preferred embodiment, the vise may be squeezed between about 30 seconds and about one minute. The dies function by applying pressure around the outer edges of the leaves, and help to seal the adhesive on the cover of the card book. As a result, a pocket is created which is formed by sealing the first leaf and part of the second leaf to the inner surface of the cover using the L-shaped adhesive strip.

While the overall design of the wallet size card book in the '401 patent has been successful commercially, there still remains a need for an improved wallet size card book which can be produced more efficiently to meet the ever increasing demands for the card book.

SUMMARY OF THE INVENTION

The present invention relates to an improved wallet size card book which is of a suitable size and configuration large enough to retain a conventional size credit card and yet small enough to fit within the card compartments of a wallet or similar type compartment holder. The improvements in the card book include construction changes to the pocket portion of the card book. These changes permit a faster and more efficient manufacturing process. By maintaining all the leaves of the card book the same size as the card book cover, rather than cutting one leaf shorter and narrower than the cover, and applying an L-shaped adhesive strip along at least two adjacent edges of the rear surface of the first leaf (fly), a second leaf is secured to the first leaf, resulting in the formation of the pocket part. The confronting surfaces of the fly leaf and cover are joined with a flood coated adhesive. In manufacturing the improved wallet size card book, the flood coated adhesive and the adhesive which forms strip may be applied in any conventional fashion. Further, dies of the type described in U.S. Pat. No. 5,595,401 are no longer necessary.

In accordance with the present invention, the wallet size card book comprises: a) a cover having a fold which divides the cover into a front panel and a rear panel; b) a plurality of leaves attached at the fold to form pages, each of the leaves and the front and rear cover panels being coextensive; c) a flood coated adhesive sealing the front surface of the first leaf to the inner surface of the front cover panel; d) an adhesive strip extending along at least two adjacent edges of the rear surface of the first leaf; and e) a second leaf sealed to the first leaf along the at least two adjacent edges by the adhesive strip, thereby forming a pocket between the combined cover and first leaf and the second leaf, and wherein the card book is of a suitable size and configuration to retain a conventional size credit card and yet small enough to fit within the conventional card compartments of a wallet. Despite the design improvements, the card book still maintains a height dimension of approximately 3 5/16 inches to about 3 5/8 inches and a width dimension ranging between about 2 3/8 inches to about 2 5/8 inches. The use of a resin emulsion adhesive, preferably a polyvinyl acetate copolymer emulsion, makes it possible to create a properly formed pocket for holding and protecting the card or information card.

The smaller size card book coupled with the same standard size for credit cards requires a substantially narrower glue strip along two adjacent sides. Accordingly, the adhesive must possess the following properties for use in the wallet size card book of the present invention: 1) sufficient bond strength; 2) fast cure to porous substrates under ambient conditions; and 3) sufficient bond flexibility. The adhesive strip that is used to seal leaves of wallet size card books comprises an adhesive selected from the group consisting of latexes of polyvinyl ethylene, polyvinyl acetate, acrylics and any copolymer thereof, natural rubber latex, natural rubber solvent-based, protein glue, carbohydrate polymer, aerobic adhesives, cyanoacrylates, silicones, and epoxy resins. The preferred adhesive is a polyvinyl acetate copolymer latex with a glass transition temperature (Tg) approximately near or below room temperature. For purposes of discussion herein, the narrow adhesive strip is described in connection with a wallet size card book. It is, however, contemplated that the adhesive strip may be used in other applications where the creation of a pocket is desired.

These and other aspects of the present invention will become apparent to those skilled in the art after a reading of the following description of the preferred embodiment when considered with the drawings.

BRIEF DESRCIPTION OF THE DRAWINGS

DESCRIPTION OF THE PREFERRED EMBODIMENTS

Figure 1:
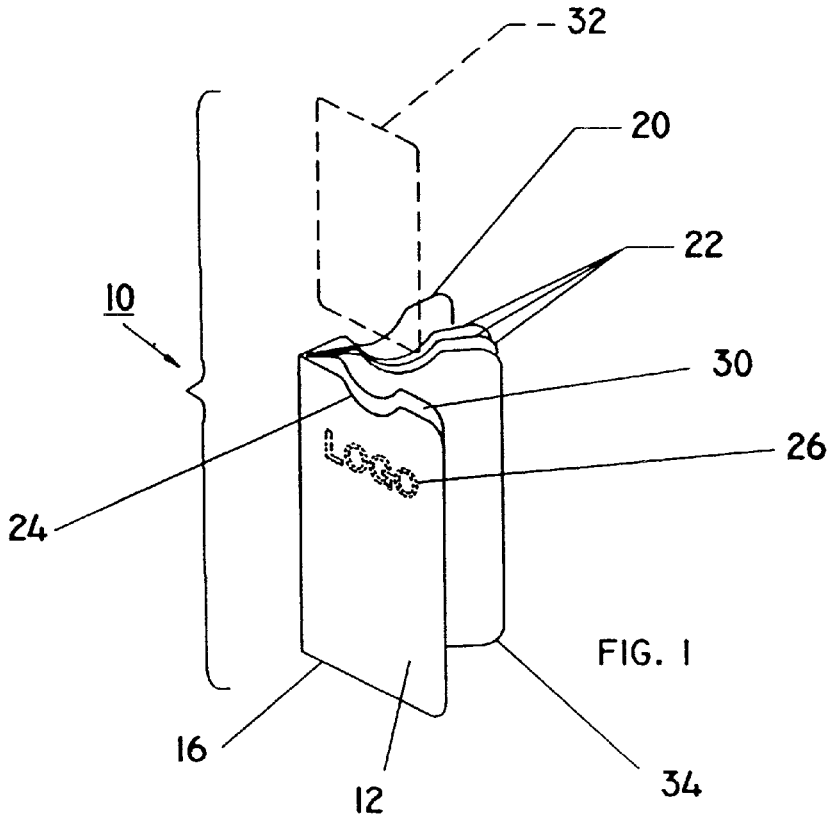
FIG. 1 is a perspective view of an improved wallet size card book constructed according to the present invention.
Figure 2:
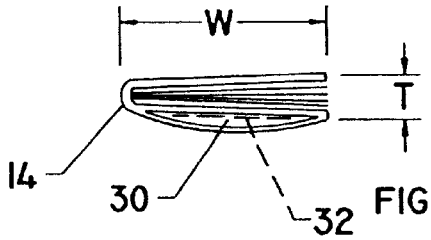
FIG. 2 is a top view of the wallet size card book.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Figure 6:
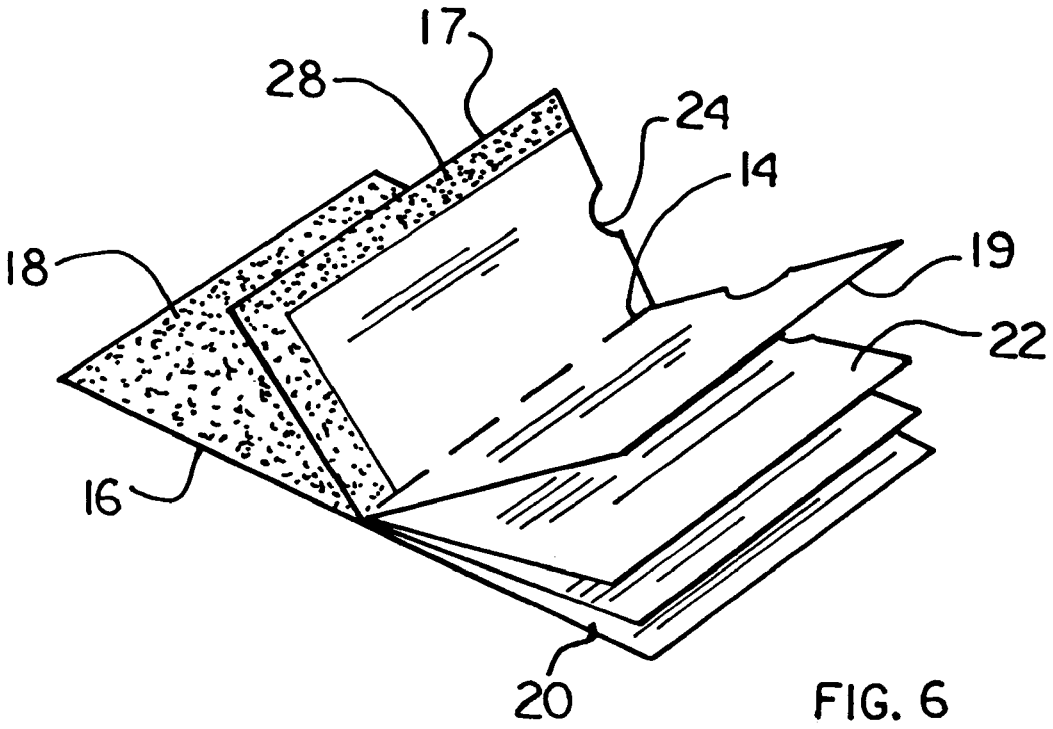
FIG. 6 is a perspective view of the wallet size card book in an open position with the first and second leaves separated from the cover and the first leaf, respectively.
Figure 7:
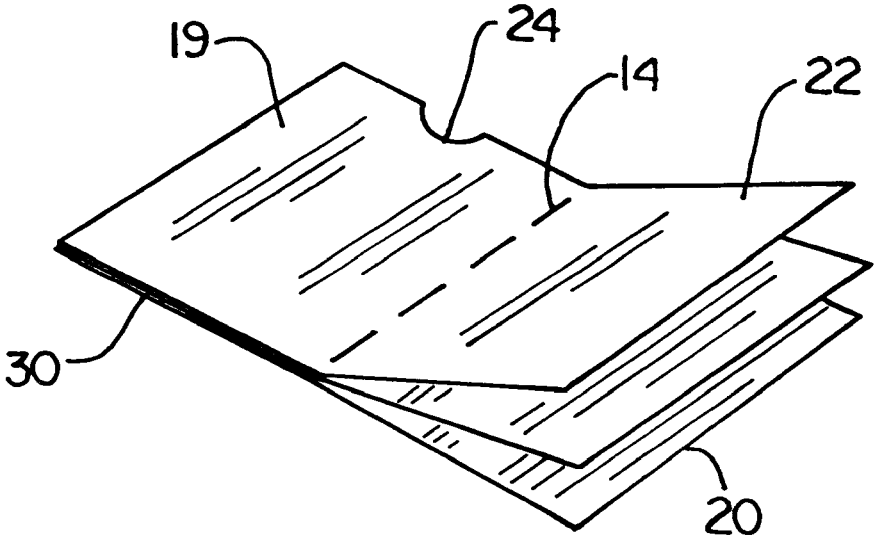
FIG. 7 is a perspective view of the card book in an open position.

Referring now to the drawings in general and FIG. 1 in particular, it will be understood that the illustrations are for the purpose of describing a preferred embodiment of the invention and are not intended to limit the invention thereto. As best seen in FIG. 1, the wallet size card book, generally designated 10, comprises a cover 12 having a fold 14 which divides the cover into a front cover panel 16 and a rear cover panel 20, a plurality of leaves 22 attached along one marginal edge at fold 14, with the leaves forming pages. In contrast to the invention of U.S. Pat. No. 5,595,401 where the first leaf is cut shorter and narrower than the cover panels, all of leaves 22 and the front 16 and rear 20 cover panels are coextensive. As shown in FIG. 6 and FIG. 7, adhesive strip 28 extends along at least two adjacent edges of the rear surface of the first leaf 17. A second leaf 19 is sealed to the first leaf 17 along the at least two adjacent edges by the adhesive strip 28, thereby forming a pocket 30 between the first leaf 17 and the second leaf 19. A flood coated adhesive 18 seals the front surface of the first leaf 17 to the inner surface of the front cover panel 16. Pocket 30 is designed for holding and protecting a wallet size credit card 32 or comparable size information card. Further, the improved card book 10 is of a suitable size and configuration to retain a conventional size credit card and yet small enough to fit within the conventional card compartments of a wallet.

The card book 10 further includes arcuate recesses 24 in the upper edges of the cover 12 and plurality of leaves 22. Cover 12 is preferably formed of a lexide material, and indicia 26, for example, a logo, may be placed on the front cover panel 16 of the book.

There are a large number of commercially available adhesives which may be used for card book 10. The required properties for use in the wallet size card book are: 1) sufficient bond strength, a minimum of 10 pounds/linear inch; 2) fast cure to porous substrates under ambient conditions; and 3) sufficient bond flexibility so as not to tear under normal use of the product. Sufficient bond strength is defined as that which will endure beyond cohesive failure of the substrate. Fast cure is relative to the manufacturing procedure being used, but generally means that the development of green tack should require between about 5 to about 10 seconds. The bond must also be able to endure the routine flexing of the card book 10, and must not embrittle with age. Any adhesive meeting these requirements can be used for the L-shaped adhesive strip 28 in the manufacture of the card book 10.

The following adhesives may be used in the card book 10; however, these examples are by no means exhaustive. The preferred adhesives for the card book application are latexes of polyvinyl ethylene, polyvinyl acetate, other acrylics, or copolymers of these. They meet all the requirements as described above, are water based, and are easy to work with during the manufacturing process. The preferred adhesive is a polyvinyl acetate copolymer latex with a glass transition temperature (Tg) approximately near or below room temperature.

Protein glues, in both dry and liquid form, on porous substrates such as paper, develop good strength, cure quickly at room temperature, and exhibit flexibility. Protein glues include soybean adhesives, animal blood adhesives, casein, and blends. This group also includes glues made from animal bone and hide (including fish), and is commonly used in bookbinding.

A number of carbohydrate-based adhesives (also known as polysaccharides) are also feasible candidates for application to card book 10. This family includes the cellulosic adhesives, starch, and gums. Although several in this group have been completely replaced by synthetic polymers, they are still widely available. Starch and gums, such as guar gum or tamarind, are good candidates and have traditionally been used as laminating adhesives for paper substrates.

Cellulose nitrate and cellulose acetate are viable, but do not age well. They will embrittle with time, and also discolor if routinely exposed to sunlight. Cellulose acetate butyrate avoids these problems, but is solvent-based and more difficult to work with. The preferred examples from this family are methyl or ethyl cellulose, and hydroxyethyl cellulose.

Natural rubber may also be used to form the L-shaped adhesive strip 28. It can be obtained either in solution (usually in toluene, naphtha, or trichloroethylene), or as a water-based latex. Although it possesses sufficient properties, consistency and availability are potential problems.

There are several other classes of adhesives which have sufficient properties, but may not be optimum choices for application in the present invention due to cost, handling and/or storage problems. These include cyanoacrylate adhesives, silicone adhesives, epoxy resins, and others. Further, although they exhibit excellent properties and are relatively easy to use, the new aerobic adhesives fall within this category at the present time due to their high cost.

There are a number of adhesive types which are not commercially viable for application in the present invention due to their curing conditions and/or lack of flexibility. These would include such adhesive types as hot melt, phenolic, polysulfide, and anaerobic adhesives. While it is possible some of these adhesives could be made useable through such mechanisms as catalysts to reduce required cure temperature, the cost would most likely be prohibitive. Those systems which require a high temperature cure usually require temperatures in excess of 110 degrees Celsius (225 degrees Fahrenheit). Such temperatures would scorch the paper substrate of the card book.

In one embodiment of the present invention, the L-shaped adhesive strip 28 comprises a resin emulsion adhesive (Evans No. 04053, Evans Adhesive Corp., Columbus, Ohio). The composition of Evans No. 04053 comprises a vinyl acetate ethylene copolymer emulsion. The adhesive may include other additives, for example, a defoamer. The copolymer emulsion is water-based and contains approximately 45% water; and the vinyl acetate ethylene content in the copolymer is approximately >90.0 wt. %. It is contemplated that any comparable adhesive may be used to form the L-shaped adhesive strip 28.

The width of the adhesive strip ranges between 1/16 inch to about 1/4 inch. The adhesive strip 28 preferably extends approximately 1/16 inch from the bottom edge and about 3/16 inch from the side edge of the rear surface of first leaf 17.

Figure 3:
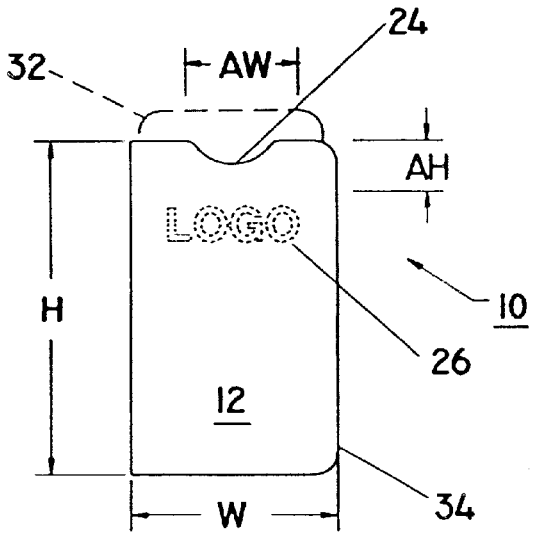
FIG. 3 is a front view of the front cover panel of the wallet size card book.
Figure 4:
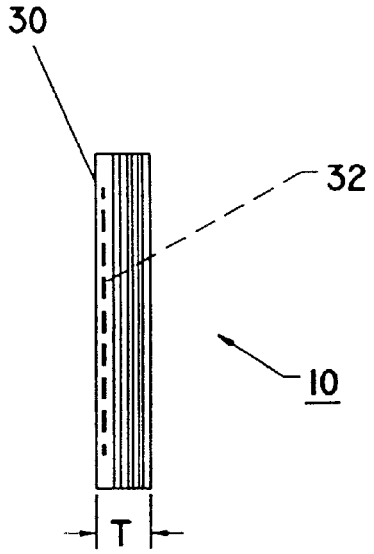
FIG. 4 is a side view of the wallet size card book.

As shown in FIG. 3, the book 10 has upper and lower rounded edges 34 opposite the fold 14. Rounded edges 34 are between about 1/8 inch to 3/8 inch in diameter, with a preferred diameter of 1/4 inch. The height H of book 10 ranges between approximately 3 5/16 inches to about 3 5/8 inches, with a preferred height of 3 1/2 inches. The width W of book 10 ranges between about 2 3/8 inches to about 2 5/8 inches, with a preferred width of 2 1/2 inches. As shown in FIGS. 24, the thickness T of book 10 ranges between about 1/16 inch to about 3/16 inch with a preferred thickness of 1/8 inch.

Again referring to FIG. 3, the arcuate recesses 24 have a width AW ranging between approximately 7/8 inch and 1 1/8 inches, with a preferred width of 1 inch.

The depth AH of recess 24 ranges between 3/16 inch and 3/8 inch, with a preferred depth of 1/4 inch. The arcuate recesses facilitate the insertion and removal of card 32 from pocket 30.

Figure 5:
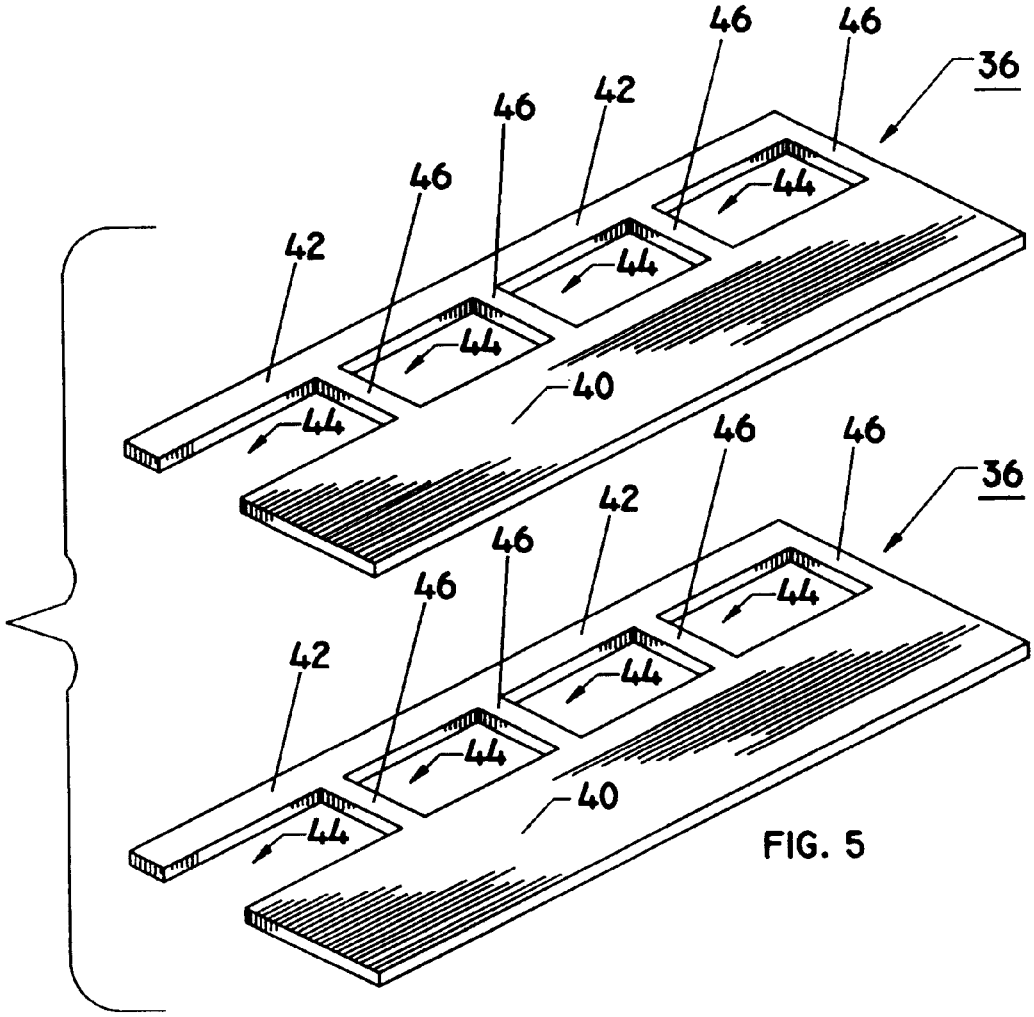
FIG. 5 is a perspective view of the upper and lower dies as disclosed in the parent patent.

As a result of the re-design of pocket 30 in card book 10, the inventors have made possible a more efficient process for producing card book 10, which eliminates the need to use dies 36 of the type shown in FIG. 5. By way of comparison, in the process of U.S. Pat. No. 5,595,401, at least one card book is placed in an open position where the plurality of leaves are attached to the fold of the cover. The first or fly leaf is cut shorter and narrower than the cover so that when the resin emulsion adhesive is applied to the entire inner surface of at least one cover, the first leaf completely adheres to the cover, and leaves an L-shaped adhesive strip exposed along the marginal edges of the inner surface of cover. As a result, a second leaf adheres to the L-shaped adhesive strip that remains exposed on the inner surface of cover, thereby forming a pocket with a third edge being attached at the fold and a fourth edge remaining open for receiving a card. In the process described in U.S. Pat. No. 5,595,401 , three books are placed end to end in an upstate position. Anywhere from approximately 12–18 books may be placed between two dies 36 of the type shown in FIG. 5 immediately after the resin emulsion is applied. Die 36 includes a lower strip 40 and an upper narrow strip 42. A plurality of openings 44 exists between the upper and lower strips 40,42. Between adjacent openings 44 are adjoining strips 46. The books and dies 36 are placed in an air-powered vise, and thereafter squeezed together in order to set the adhesive. The vise is squeezed under approximately 2800 lbs/in$^2$ of pressure for a sufficient amount of time in which to properly seal the adhesive to the cover. The pressure may range between about 2000 and 4000 lbs/in$^2$. In one embodiment, the vise may be squeezed between about 30 seconds and about one minute. The dies 36 function by applying pressure around the outer edges of the leaves, and help to seal the adhesive on the cover of card book. As a result, a pocket is created which is formed by sealing the first leaf and part of the second leaf to the inner surface of cover using the L-shaped adhesive strip.

Although dies 36 may be used to carry out the process of producing card book 10, they are no longer necessary. Instead, card books 10 may be manufactured at faster production rates by applying the adhesive in the form of strip 28 to the rear surface of first leaf 17 in any appropriate fashion commonly used in production manufacturing. Adhesive 18 is preferably applied between the cover 12 and first leaf 17 by a flood coating process. It is also contemplated that the adhesives used to seal the first leaf 17 to cover 12 and to create the L-shape configuration for sealing the first leaf 17 to the second leaf 19 may be chemically similar.

Certain modifications and improvements will occur to those skilled in the art upon a reading of the foregoing description. By way of example, it is contemplated that the card book of the present invention can be modified for use in a variety of industries including but not limited to financial institutions, telecommunications, healthcare, information security, travel and hospitality and prepaid vending. The card book may, thus, be customized to hold information about a particular organization and its services, programs, etc.

It should be understood that all such modifications and improvements have been deleted herein for the sake of conciseness and readability, but are properly within the scope of the following claims.

We claim:

1. A wallet size card book comprising:

a) a cover having a fold which divides the cover into a front panel and a rear panel;

b) a plurality of leaves attached at the fold to form pages, each of the leaves and the front and rear cover panels being coextensive;

c) a flood coated adhesive sealing the front surface of the first leaf to the inner surface of the front cover panel;

d) an adhesive strip extending along at least two adjacent edges of the rear surface of the first leaf; and e) a second leaf sealed to the first leaf along the at least two adjacent edges by the adhesive strip, thereby forming a pocket between the combined cover and first leaf and the second leaf, and wherein the card book is of a suitable size and configuration to retain a conventional size credit card and yet small enough to fit within the conventional card compartments of a wallet.

2. The wallet size card book according to claim 1, wherein the card book has a height dimension of approximately 3 5/16 inches to about 3 5/8 inches and a width dimension ranging between about 2 3/8 inches to about 2 5/8 inches.

3. The wallet size card book according to claim 1, wherein the dimensions of the card book are approximately 2½ inches by about 3½ inches.

4. The wallet size card book according to claim 1, wherein the adhesive strip extending along at least two adjacent edges forms an L-shaped configuration.

5. The wallet size card book according to claim 1, wherein the adhesive strip preferably extends approximately 1/16 inch from the bottom adjacent edge and approximately 3/16 inch from the side adjacent edge of the rear surface of the first leaf.

6. A wallet size card book comprising:

a) a cover having a fold which divides the cover into a front panel and a rear panel;

b) a plurality of leaves attached along one marginal edge at the fold to form pages in the card book, each of the leaves and the front and rear cover panels being coextensive;

c) an adhesive strip extending along at least two marginal edges between the first and second leaves, the adhesive strip being of a width sufficient to adhere the second leaf to the first leaf, the width ranging between about 1/16 inch to about 3/16 inch; and d) a pocket formed by the first leaf being sealed to the inner surface of the front cover panel and the second leaf being sealed to the first leaf along the at least two marginal edges by the adhesive strip, wherein the card book is of a suitable size and configuration to retain a conventional size credit card and yet small enough to fit within the conventional card compartments of a wallet.

7. The wallet size card book according to claim 6, wherein the adhesive strip extends along the bottom and side marginal edges of the rear surface of the first leaf and forms an L-shaped configuration.

8. The wallet size card book according to claim 6, wherein the. card book has a height dimension of approximately 3 5/16 inches to about 3 5/8 inches and a width dimension ranging between about 2 3/8 inches to about 2 5/8 inches.

* * * * *